US005424497A

United States Patent [19]

Dias et al.

[11] Patent Number: 5,424,497

[45] Date of Patent: Jun. 13, 1995

[54] SOUND ABSORBING WALL PANEL

[75] Inventors: Gary R. Dias; Richard Montgomery, both of Folsom, Calif.

[73] Assignee: California Prison Industry Authority, Folsom, Calif.

[21] Appl. No.: 186,756

[22] Filed: Jan. 25, 1994

[51] Int. Cl.[6] ..... E04B 1/82

[52] U.S. Cl. ..... 181/290; 181/292; 181/286; 52/145

[58] Field of Search ..... 181/286, 287, 288, 290, 181/292, 294, 295; 52/144, 145

[56] References Cited

U.S. PATENT DOCUMENTS

| | | | |
|---|---|---|---|
| 2,839,442 | 6/1958 | Whitaker | 428/116 |
| 3,592,288 | 7/1971 | Walter | 181/287 |
| 3,676,279 | 7/1972 | Beaver | 428/73 |
| 3,713,508 | 1/1973 | Eckel | 181/287 |
| 3,934,382 | 1/1976 | Gartung | 181/288 |
| 4,084,366 | 4/1978 | Saylor et al. | 181/292 X |
| 4,084,367 | 4/1978 | Saylor et al. | 181/292 X |
| 4,155,211 | 5/1979 | Saylor et al. | 181/295 X |
| 4,353,947 | 10/1982 | Northcutt | 428/116 |
| 4,630,416 | 12/1986 | Lapins et al. | 181/286 X |
| 4,759,964 | 7/1988 | Fischer et al. | 428/116 |
| 4,838,524 | 6/1989 | McKeown et al. | 181/290 X |
| 4,879,152 | 11/1989 | Green | 428/116 X |
| 5,009,043 | 4/1991 | Kurrasch | 181/290 X |
| 5,106,668 | 4/1992 | Turner et al. | 428/116 X |

FOREIGN PATENT DOCUMENTS 1227345 8/1960 France .

*Primary Examiner*—Khanh Dang
*Attorney, Agent, or Firm*—John P. O'Banion

[57] ABSTRACT

A movable, prefabricated wall panel having a rigid rectangular frame, a septum core disposed within the region bounded and confined by the frame, and adjacent layers of fibrous sound absorbing material is disclosed herein. The septum core is formed from a central layer of honeycombed-shaped paper sandwiched between two steel skins, and is fixedly confined to the center of the interior frame perimeter by elongated channels of the perimeter frame. The combined shape forms a central cavity on opposing sides of the septum core allowing relatively thick inner layers of sound absorbing fibrous material, preferably fiberglass, to be placed within the panel adjacent to each steel skin. Outer layers of sound absorbing fibrous material are placed adjacent to the inner layers, and the outer layers are covered with fabric or similar material.

13 Claims, 6 Drawing Sheets

SOUND ABSORBING WALL PANEL

BACKGROUND OF THE INVENTION

1. Field of the Invention

This invention pertains generally to wall panels, and more particularly to an acoustical wall panel which possesses a high noise reduction coefficient and a high sound transmission coefficient while additionally possessing sufficient strength to permit fixtures and accessories to be hung thereon.

2. Description of the Background Art

Wall structures formed from a plurality of interconnected, prefabricated and portable panels are used extensively in commercial and industrial buildings for dividing interior regions into smaller work regions. Such structures have proven particularly effective in providing greater privacy within the building, and at the same time improving the interior appearance. For this purpose, the panels are provided with many different exterior finishes, such as colored plastics, carpets and fabrics. Some of these panels also tend to minimize noise, particularly when they are provided with soft exterior finishes, such as by being covered with carpeting or fabric. Many panels of this type are also provided with slotted rails extending vertically along the edges thereof, whereupon fixtures such as work surface tops, shelves, filing cabinets and the like can be mounted on the panels. Due to the desire to mount these fixtures on the panels, the panels thus must be provided with substantial strength and, accordingly, current panels are normally provided with a relatively strong and rigid core so as to provide the necessary strength.

While panels of the above type do tend to minimize noise, nevertheless any noise absorption capability of the panel is normally provided solely by the outer coverings. Further, since these panels are normally of a height, substantially less than the floor-to-ceiling height, this also permits the transmission of substantial noise over the panel which, when coupled with the inability of these panels to absorb a high percentage of sound at various frequencies, thus results in poor sound reduction. Because of this inability to absorb a high percentage of the sound in the environment, these known panels have conventionally been referred to as non-acoustical-type panels.

In an attempt to provide a panel capable of absorbing a high percentage of directed sound at various frequencies, there are known several so-called "acoustical-type" panels which are more effective in absorbing the environmental noises surrounding the panels. However, to achieve this noise absorption capability, these panels normally comprise a fiberglass core with fabric coverings, the core being surrounded by a rectangular frame which constitutes the sole structure for providing the panel with structural strength. These panels, due to the lack of a significant structural design within the core, do not possess the strength and rigidity necessary to permit fixtures such as shelves and the like to be hung thereon. Further, these known acoustical panels possess limited durability and are easily damaged due to the softness and lack of strength possessed by the core of the panel.

In recognition of the need for an acoustical panel, the American Society of Testing Materials (ASTM) has defined industry standards for testing the sound absorption quality of movable partitions. These standards require that a panel be tested at sound wave frequencies of 250, 500, 1000 and 2000 cycles per second. The panel is rated on a scale of from 0 to 1.0, and the greater the sound absorption capability of the panel, the higher the numerical rating. This numerical rating, which is normally referred to as the Noise Reduction Coefficient (NRC), is averaged over the four test frequencies set forth above. Furthermore, a Sound Transmission Coefficient (STC) is used as an indicator of the amount of sound transmitted through the panel, on a scale of from 0 to 100, wherein higher numerical ratings denote less sound transmission. At the present time, the known acoustical panels which are capable of having fixtures hung thereon do not have satisfactorily high NRC's and STC's, whereas the known acoustical panels which utilize a core constructed totally of fiberglass are relatively weak and unstable, and often do not permit fixtures and the like to be hung thereon. As can be seen, therefore, in order to achieve stability, noise reduction is sacrificed.

Therefore, there is a need for an acoustical type panel having a high noise reduction coefficient and a high sound transmission coefficient which provides sufficient structural integrity to support fixtures such as shelves, cabinets and the like. The present invention satisfies that need, as well as others, and overcomes the deficiencies found in prior panels.

SUMMARY OF THE INVENTION

The present invention pertains to a sound absorbing panel for use with a wall system formed from a plurality of such panels. The panel is movable, portable, and capable of supporting hang-on office component furniture. Further, the panel is capable of absorbing substantial quantities of airborne sound waves of different frequencies.

By way of example, and not of limitation, the panel includes a septum core structure positioned within and contained by a surrounding rectangular frame structure. The septum core structure comprises a honeycomb core sandwiched between two thin sheetlike structural skins, such as sheet metal skins, which are bonded to the honeycomb on opposing sides. The frame is formed by elongated shaped metal, such as roll formed metal or extrusion, which have their adjacent ends connected together in a fixed position. The septum core structure is then contained by a channel of the surrounding elongated shaped metal frame. The combined structure provides a cavity for the insertion of a relatively thick layer of sound absorbing fibrous material, such as a layer of fiberglass, on opposing sides of the framed septum core. An additional thin layer of sound absorbing fibrous material, such as fiberglass, is placed over each layer of fibrous material and extends to the edges of the surrounding frame on opposing sides of the frame. The outer layer of fibrous material is in turn covered by a thin layer of decorative fabric on opposing sides of the frame. The combination of aforementioned components provides a substantially strong structural panel while still permitting the panel to absorb substantial quantities of sound waves having different frequencies, consequently providing the panel with a high noise reduction coefficient and a significant sound transmission coefficient.

Another object of the invention is to provide an acoustical wall panel which possesses a relatively high noise reduction coefficient (NRC), such as at least 0.75 or above.

Another object of the invention is to provide an acoustical wall panel which possesses a relatively high sound transmission coefficient (STC), such as at least 34 or above.

Another object of the invention is to provide an acoustical wall panel which utilizes a septum core structure capable of blocking sounding transmission with a high degree of efficiency.

Another object of the invention is to provide an acoustical wall panel which possesses substantial strength and durability.

Another object of the invention is to provide an acoustical wall panel which utilizes a septum core structure of honeycomb and stressed skins providing the panel with strength and rigidity.

Another object of the invention is to provide an acoustical wall panel having a septum core constructed from a honeycomb structure which defines a plurality of cells, which cells are covered by the stressed skins providing a high sound transmission coefficient rating.

Another object of the invention is to provide an acoustical wall panel having a septum core and adjacent cavity for receiving a thick layer of sound absorbing fibrous material, such as fiberglass, on opposing sides of core thereby obtaining a higher sound absorbance rating of different frequencies.

Another object of the invention is to provide an acoustical wall panel which can be manufactured in an economical manner.

Another object of the invention is to provide an acoustical wall panel which possesses the structural characteristics of prior panels having relatively low sound absorbing capacity, but which provides substantially higher sound absorbing capability.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Referring more specifically to the drawings, for illustrative purposes the present invention is embodied in the apparatus which is generally shown in FIG. 1 through FIG. 4. It will be appreciated that the apparatus may vary as to configuration and as to details of the parts without departing from the basic concepts as disclosed herein.

Figure 1:
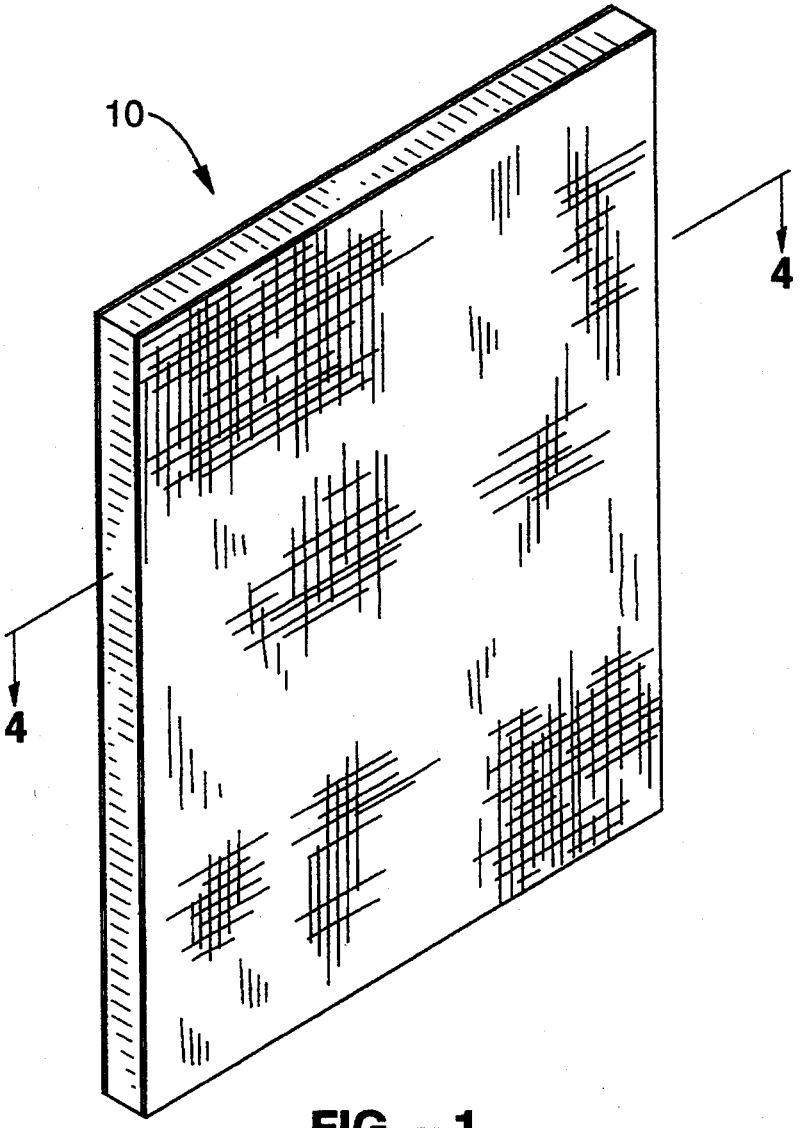
FIG. 1 is a perspective assembled view of a wall panel in accordance with the present invention.

Referring to FIG. 1, the present invention generally comprises a wall panel 10, which is prefabricated, movable and portable. The wall panel 10 of the present invention is generally intended to be used as a component in a wall system formed from a plurality of such wall panels. The panels may be connected end-to-end, in angular relationships, or in any variety of freestanding and supported configurations using conventional coupling devices.

Figure 2A:
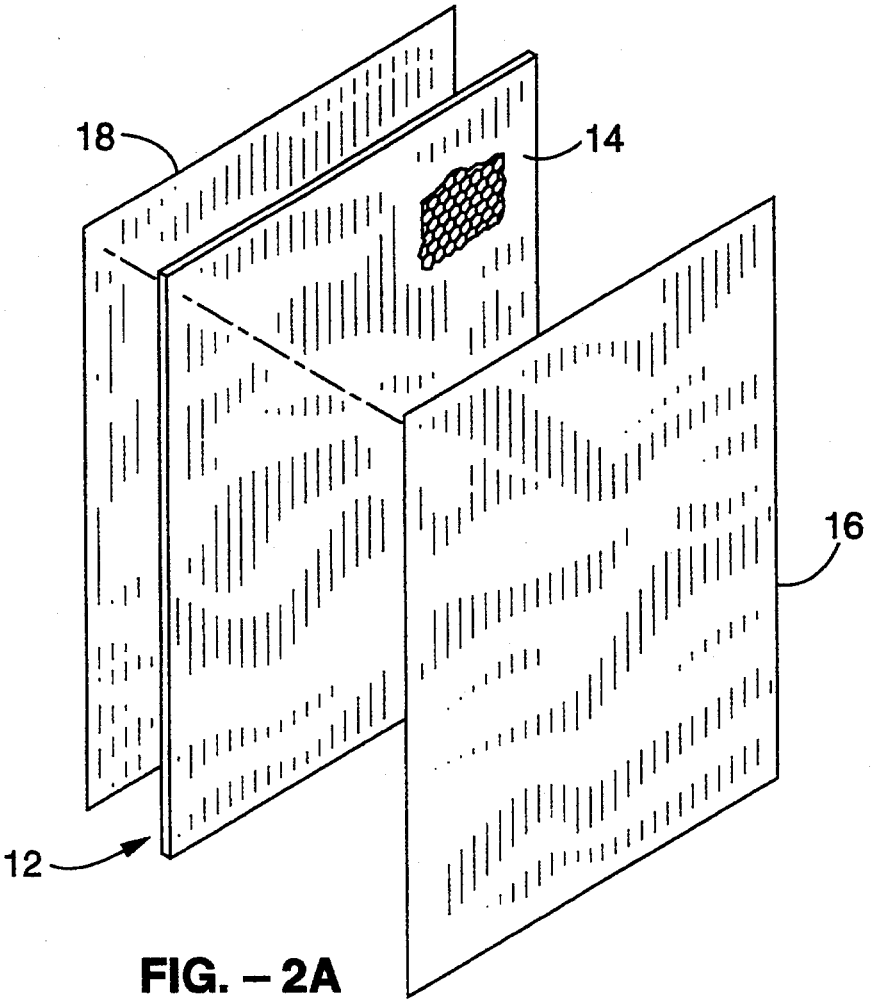
FIG. 2A is an exploded view of the septum core subassembly of the apparatus shown in FIG. 1.
Figure 3:
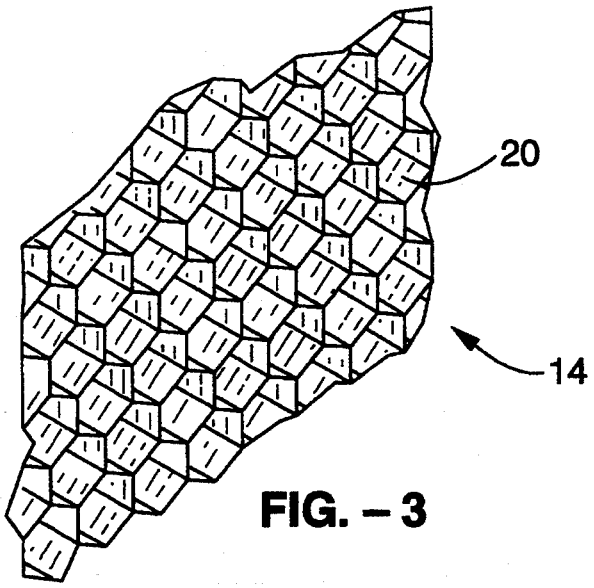
FIG. 3 is an enlarged detail view of the honeycomb portion of the subassembly shown in FIG. 2A.

Referring also to FIG. 2A and FIG. 3, a wall panel in accordance with the present invention includes a generally planar septum core subassembly 12, which comprises a core 14 disposed between opposing skins 16, 18. In the preferred embodiment, core 14 is formed from one-half inch (12.7 mm) thick honeycomb-shaped kraft paper having a plurality of cells 20 with openings facing skins 16, 18. The cells are three-eighth inch (9.5 mm) across and are faced on both sides with sixty-nine pound kraft paper (not shown). In this manner, core 14 is rigid and can withstand lateral forces placed on skins 16, 18 without risk of collapse. Alternatively, core 14 could be formed from plastic or the like, provided that the honeycomb shape is retained. Skins 16, 18 are preferably foraged from solid sheets of 0.18 inch (0.5 mm) twenty-six gage galvanized steel or the like, and are laminated to the kraft paper on both sides of core 14 using conventional adhesives. Alternatively, the kraft paper can be omitted so that cells 20 are open, in which case skins 16, 18 would be glued or otherwise rigidly bonded directly to the edges of the cells. Skins 16, 18 are laminated to the kraft paper on both sides of core 14 using conventional adhesives. Note also, that by employing a thicker core 14, cells 20 could be made larger; however, the cell size and thickness should be matched to provide a rigid core 14.

The foregoing septum core subassembly 12 provides a rigid structure which blocks the transmission of sound as a result of its configuration. By employing a honeycomb shaped core 14, superior rigidity from a lightweight material is achieved. Further, by sandwiching the core 14 between steel skins 16, 18, the resulting structure blocks transmission of sound and exhibits a very high sound transmission coefficient (STC).

Figure 2B:
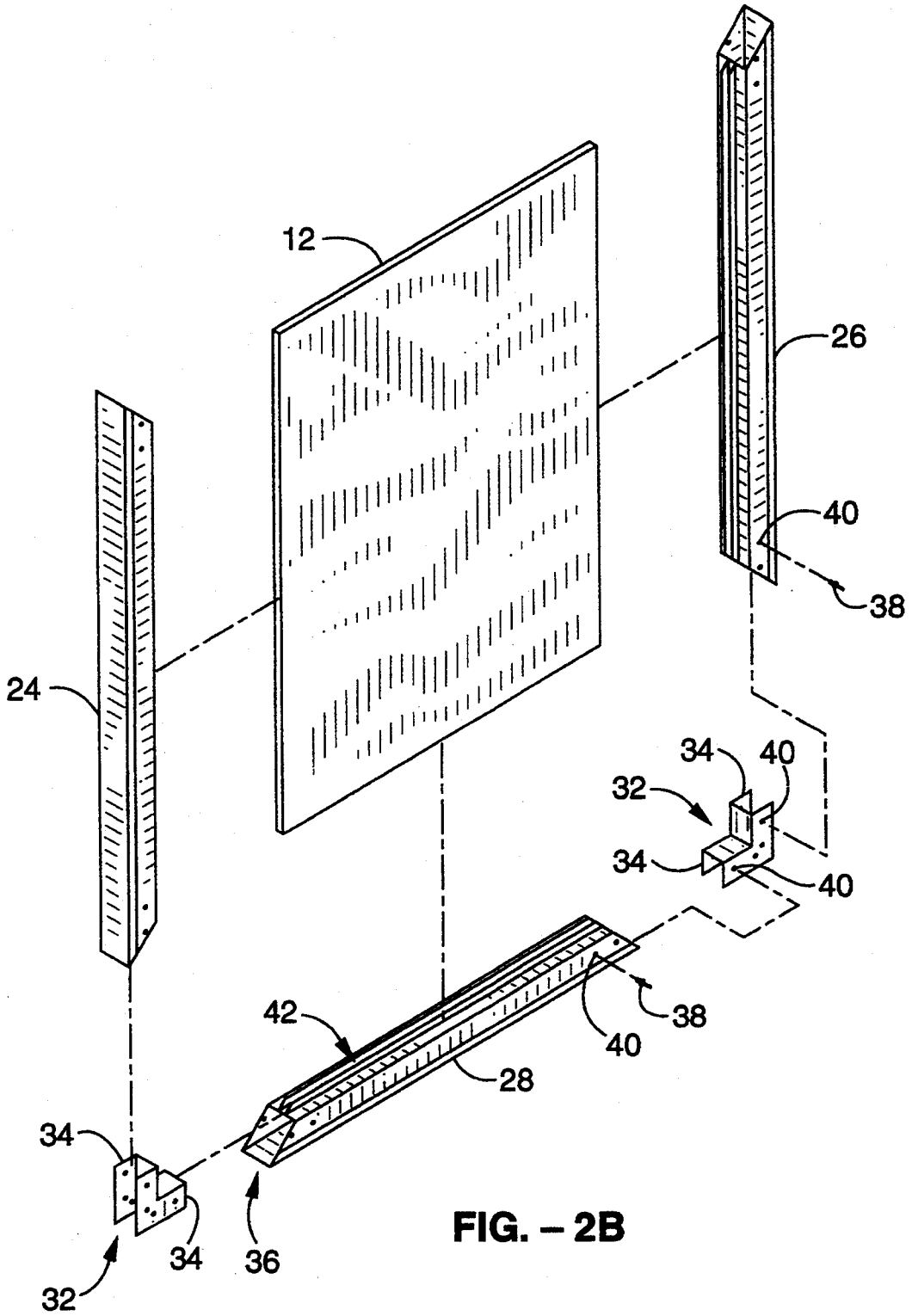
FIG. 2B is an exploded view showing the septum core subassembly of FIG. 2A the bottom and side members of the frame portion of the apparatus of FIG. 1.
Figure 2C:
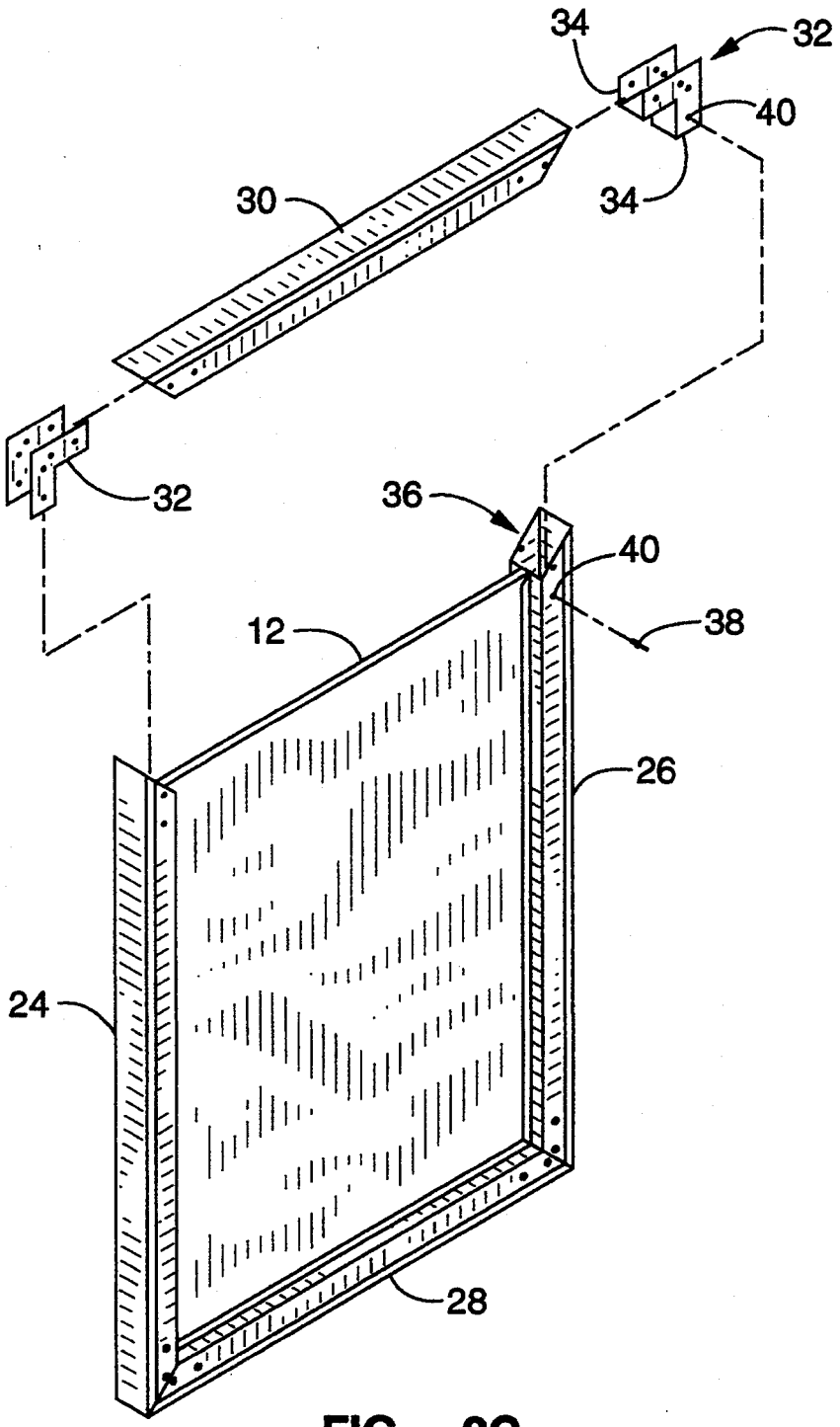
FIG. 2C is an exploded view showing the top member of the frame portion of the apparatus of FIG. 1 and the subassembly of FIG. 2B.

Referring also to FIG. 2B, 2C, 2D and 4, septum core subassembly 12 is positioned within and contained by a surrounding frame 22 which, in the preferred embodiment, is square or rectangular in shape. Frame 22 includes opposing side members 24, 26, as well as a bottom member 28 and an opposing top member 30. These members, which are elongated and tubular as shown, can be formed from rigid lightweight material, such as aluminum or the like, in any conventional manner. Referring more specifically to FIG. 2B and 2C, it can be seen that the frame members are joined at their ends by means of angle brackets 32. Brackets 32 include legs 34 which fit within and engage openings 36 in the frame members to form a secure comer brace. Brackets 36 are then secured to the frame members using pins, rivets, sheet metal screws, or other conventional fasteners 38 which extend through holes 40 in the frame members.

Each of the frame members includes an elongated channel 42 which is centrally positioned longitudinally along the frame member. Channel 42, which extends the length of the frame member, is sized to receive an edge of septum core assembly 12 so as to secure septum core assembly 12 in the center of frame assembly 22. By first assembling side members 24, 26 and bottom member 28 as shown in FIG. 2B, septum core assembly 12 can be slidably inserted into the open end of the partial frame assembly. Top member 30 can then be installed as shown in FIG. 2C to complete frame assembly 22.

Figure 2D:
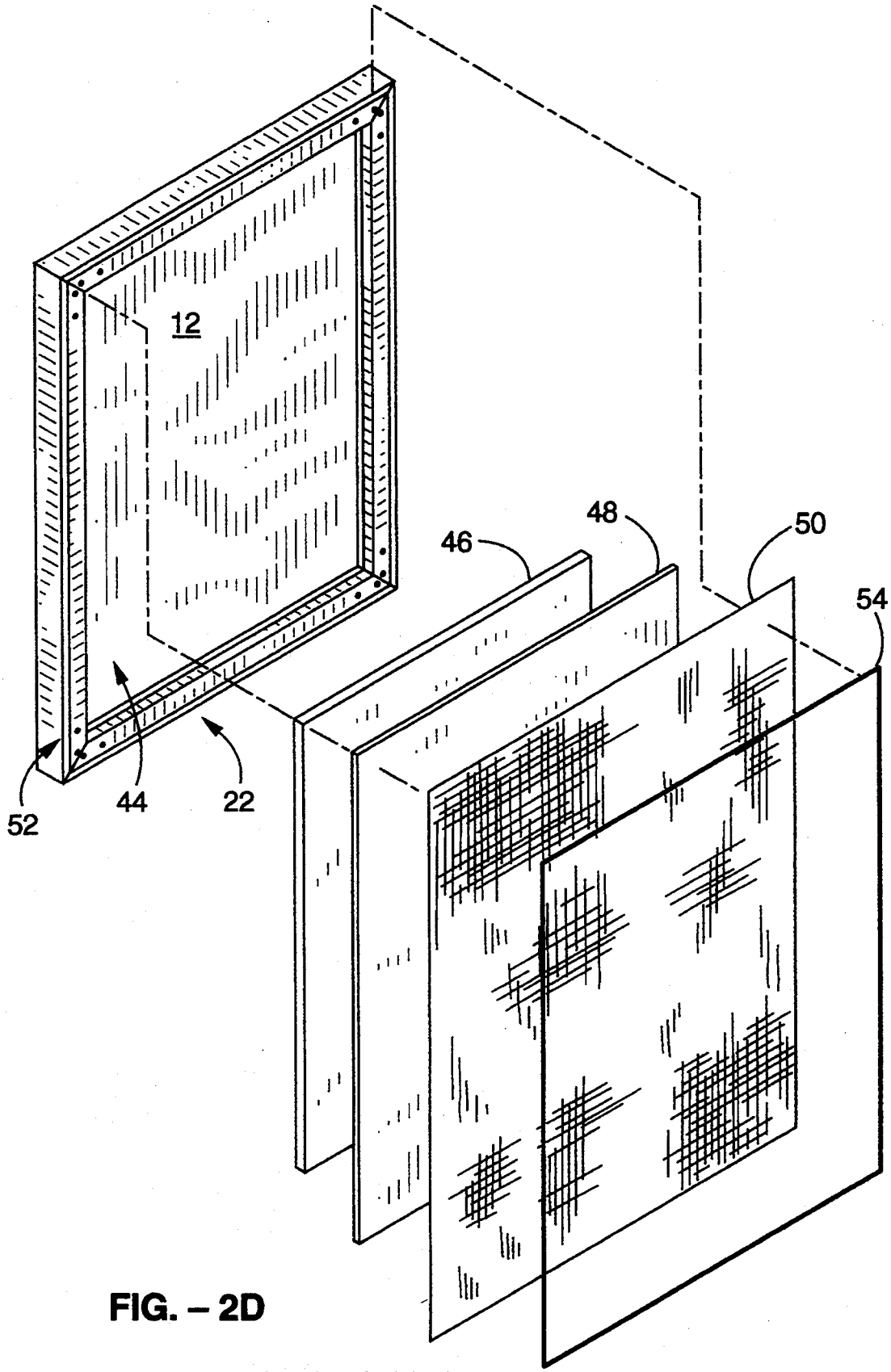
FIG. 2D is an exploded view showing the subassembly of FIG. 2C and one side of the apparatus of FIG. 1.
Figure 4:
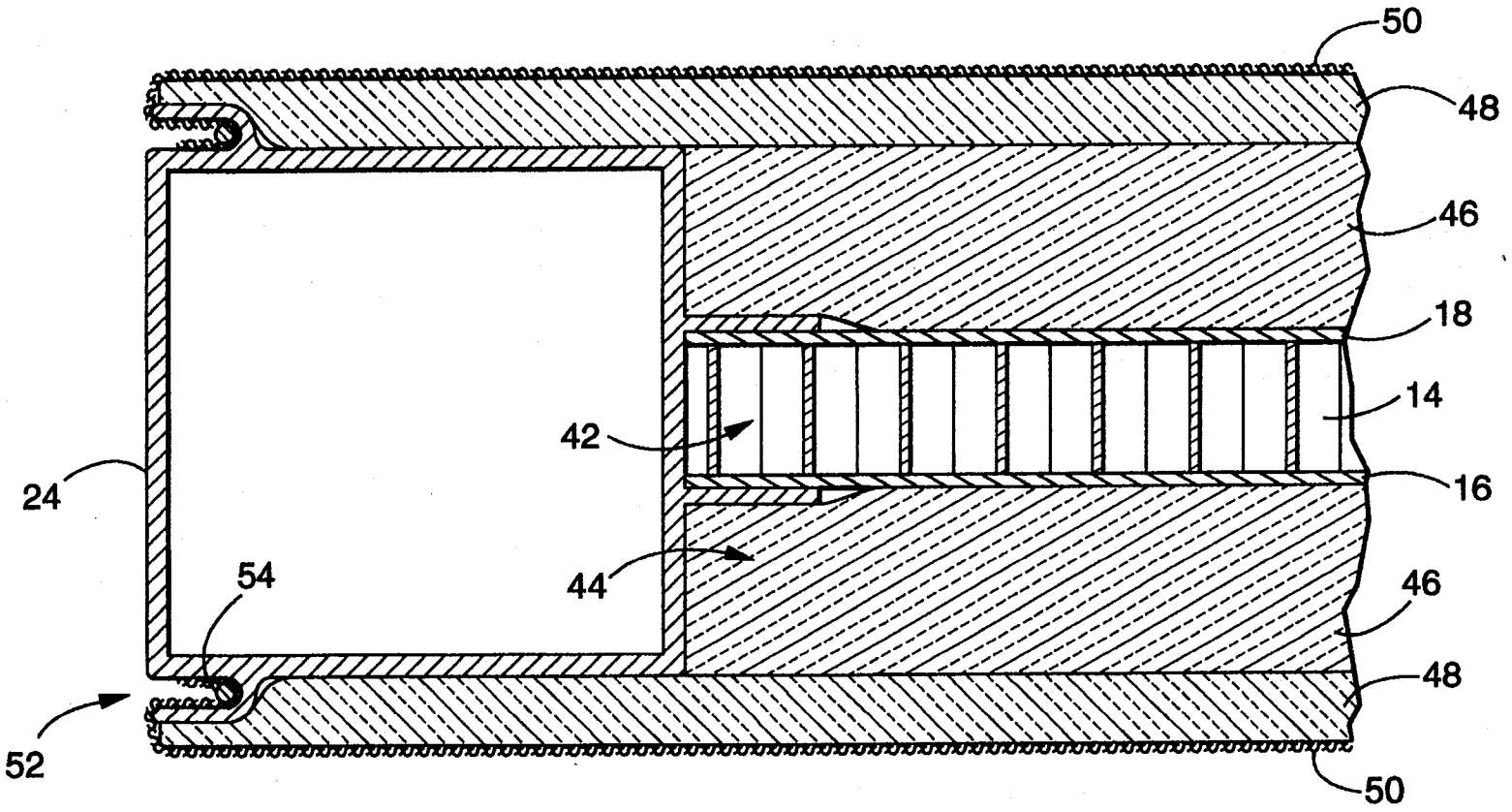
FIG. 4 is a cross-section view of the apparatus of FIG. 1 taken through line 4—4.

Referring to FIG. 2D and 4, in the preferred embodiment the frame assembly 22 includes a cavity 44 on each side of septum core subassembly 12. Each cavity 44 is sized sufficiently to permit placement of an inner sound absorbing layer 46 of sound absorbing material adjacent to each side of septum core subassembly without extending beyond the face of frame assembly 22. Preferably, inner sound absorbing layer 46 comprises three quarter inch (19 mm) sound absorbing fiberglass or the like, having a density of three pounds per cubic foot (48 kg/m$^3$). Inner sound absorbing layer 46 can be glued to a corresponding skin, or sized sufficiently for frictional engagement between its outer edges and cavity 44.

An outer sound absorbing layer 48 of sound absorbing material is placed adjacent to inner layer 46 and overlies inner sound absorbing layer 46 and frame assembly 22. Preferably, outer sound absorbing layer 48 comprises one quarter inch (6.4 mm) sound absorbing fiberglass or the like, having a density of one and one pounds per cubic foot (24 kg/m$^3$). Outer sound absorbing layer 48 is not glued to inner sound absorbing layer 46 since the glue would act as a barrier to sound which would otherwise enter inner sound absorbing layer 46 for absorption. However, since outer sound absorbing layer 48 overlies frame assembly 22, its edges are glued or otherwise fastened to the face of frame assembly 22.

Frame assembly 22 includes a retention channel 52 which extends around its periphery. A layer of decorative fabric 50 is placed adjacent to outer sound absorbing layer 48, stretched over the assembly, and is held in place by means of retention rods 54. Retention rods 54, which are any rigid round stock of plastic, compressed paper, or the like, are pressed into place within channel 52 and retain the edge of fabric 50 in place by frictional engagement.

It should also be noted that, since inner sound absorbing layer 46 is of a relatively dense fibrous material, it provides more sound absorbing capability than outer sound absorbing layer 48. Such sound absorption capability can be increased by using thicker layers. Outer sound absorbing layer 48 is a lower density material to provide, in addition to sound absorbing capability, a cushioned area beneath fabric 50.

Although FIG. 2D shows the layers of sound absorbing material and fabric covering on only one side of the wall panel 10, it will be appreciated that the layers are identically placed on both sides of septum core assembly 12 so that each side of wall panel 10 is identical. This symmetry can be seen from in the cross-section of FIG. 4. It will also be appreciated that any of the frame members in frame assembly 22 could be made of an open channel configuration, with the opening extending outward from the wall panel. In this way, the open channel could be used for routing electrical or communications wiring along the top or sides of the wall panel.

The present invention was tested for its sound absorption characteristics in accordance with ASTM C 423-90a "Standard Test Method for Sound Absorption and Sound Absorption Coefficients by the Reverberation Method" and ASTM E 795-83 "Standard Practices for Mounting Test Specimens during Sound Absorption Tests". For purposes of these tests, the decay rate of sound in a 254 cubic meter reverberation chamber (which is inversely related to sound absorption) was measured upon terminating in a broad-band pink noise signal which floods the chamber. Twenty ensemble averages containing ten decays each were measured both with the sample inside and outside the chamber. The difference between those sound absorptions at a given frequency is defined as the Sound Absorption of the specimen. The Sound Absorption Coefficient (SAC) is defined as the Sound Absorption per unit area; that is, the fraction of the randomly incident sound power absorbed by the surface. The Noise Reduction Coefficient (NRC) is a four frequency average of the SAC at selected frequencies. A Norwegian Instruments NI-830 Dual Channel Real Time Analyzer, controlled by an IBM PC-compatible computer using custom software, was used for all measurements. Measurements were made in the ISO-Preferred ⅓-Octave Bands from 100 Hz to 10 kHz. The NRC, which is the average of the SAC at frequencies of 250 Hz, 500 Hz, 1000 Hz and 2000 Hz, was found to be 0.75 for the wall panel 10 in accordance with the present invention.

For purposes of Sound Transmission Loss, testing was performed in accordance with ASTM C 423-90a "Standard Test Method for Sound Absorption and Sound Absorption Coefficients by the Reverberation Method," ASTM E 413-87 "Classification for Sound Insulation Rating," and ASTM E 90-90 "Standard Method for Laboratory Measurement of Airborne Sound Transmission Loss of Building Partitions". The Sound Transmission Loss of a partition in a specified frequency band is defined as ten times the common logarithm of the airborne sound power incident on the partition to the sound power transmitted by the partition and radiated to the other side, in decibels. The wall panel 10 was mounted in an opening in a high transmission loss filler wall installed in a 2440 mm by 2440 mm transmission loss test opening. The perimeter of the panel was packed with fiberglass and the face of the panel was sealed to the edge of the test aperture. The calculated transmission loss of the composite (wall panel and filler wall) was adjusted to account for sound power transmitted through the filler wall. Broad band pink noise was produced by a loudspeaker in the source chamber. The steady-state space-time average sound pressure levels in the source and receive room were determined using rotating microphone booms and a the NI-830 Real Time Analyzer. The sound absorption in the receiving room was measured in accordance with ASTM C 423-90a. Measurements were made in the ISO-Preferred ⅓-Octave Bands from 50 Hz to 10 kHz. Using this test, the Sound Transmission Coefficient (STC) was found to be thirty-four for a wall panel 10 in accordance with the present invention.

Accordingly, it will be seen that this invention provides a substantially strong structural panel while still permitting the panel to absorb substantial quantities of sound waves having different frequencies, consequently providing the panel with a high noise reduction coefficient and a significant sound transmission coefficient. Although the description above contains many specificities, these should not be construed as limiting the scope of the invention but as merely providing illustrations of some of the presently preferred embodiments of this invention. Thus the scope of this invention should be determined by the appended claims and their legal equivalents.

We claim:

1. A sound absorbing wall panel, comprising:

(a) a frame;

(b) a septum core, said septum core mourned in said frame, said septum core having a first side and a second side;

(c) a first cavity, said first cavity positioned within said frame adjacent to said first side of said septum core;

(d) a second cavity, said second cavity positioned within said frame adjacent to said second side of said septum core;

(e) a first inner layer of sound absorbing material, said first inner layer of sound absorbing material positioned within said first cavity and adjacent to said first side of said septum core;

(f) a second inner layer of sound absorbing material, said second inner layer of sound absorbing material positioned within said second cavity and adjacent to said second side of said septum core;

(g) a first outer layer of sound absorbing material, said first outer layer of sound absorbing material positioned adjacent to said first inner layer of sound absorbing material, said first inner and outer layers being unbonded; and (h) a second outer layer of sound absorbing material, said second outer layer of sound absorbing material positioned adjacent to said second inner layer of sound absorbing material, said second inner and outer layers being unbonded.

2. An apparatus as recited in claim 1, wherein said septum core comprises a honeycomb-shaped core, said honeycomb-shaped core having a plurality of cells, said honeycomb-shaped core laminated between generally planar layers of metal skins.

3. An apparatus as recited in claim 1, further comprising:

(a) a first fabric layer positioned adjacent to said first outer layer of sound absorbing material; and (b) a second fabric layer positioned adjacent to said second outer layer of sound absorbing material.

4. An apparatus as recited in claim 1 wherein said first and second inner layers of sound absorbing material comprise fibrous material having a density of approximately 48 kg/m$^3$.

5. An apparatus as recited in claim 4, wherein said first and second outer layers of sound absorbing material comprise fibrous material having a density of approximately 24 kg/m$^3$.

6. An acoustical wall panel, comprising:

(a) a honeycomb-shaped septum core, said core having a plurality of cells, said core laminated between a first generally planar layer of sheet metal and a second generally planar layer of sheet metal;

(b) a first cavity, said first cavity positioned adjacent to said first layer of sheet metal;

(d) a second cavity, said second cavity positioned adjacent to said second layer of sheet metal;

(e) a first inner layer of sound absorbing material positioned within said first cavity and adjacent to said first layer of sheet metal;

(f) a second inner layer of sound absorbing material positioned within said second cavity and adjacent to said second layer of sheet metal;

(g) a first outer layer of sound absorbing material positioned adjacent to said first inner layer of sound absorbing material, said first inner and outer layers being unbonded;

(h) a second outer layer of sound absorbing material positioned adjacent to said second inner layer of sound absorbing material, said second inner and outer layers being unbonded; and (i) a frame, said frame supporting said core, said sheet metal layers, said inner layers of sound absorbing material and said outer layers of sound absorbing material, said first outer layer of sound absorbing material overlying said first inner layer of sound absorbing material and a face of said frame, said second outer layer of sound absorbing material overlying said second inner layer of sound absorbing material and a face of said frame.

7. An apparatus as recited in claim 6, further comprising:

(a) a first fabric layer positioned adjacent to said first outer layer of sound absorbing material; and (b) a second fabric layer positioned adjacent to said second outer layer of sound absorbing material.

8. An apparatus as recited in claim 7 wherein said first and second inner layers of sound absorbing material comprise fibrous material having a density of approximately 48 kg/m$^3$.

9. An apparatus as recited in claim 8, wherein said first and second outer layers of sound absorbing material comprise fibrous material having a density of approximately 24 kg/m$^3$.

10. A laminated sound absorbing wall panel, comprising a frame, said frame supporting a first outer layer of sound absorbing material, a first inner layer of sound absorbing material adjacent to said first outer layer, a first skin adjacent to said first inner layer, a honeycomb-shaped septum core adjacent to said first skin, a second skin adjacent to said core, a second inner layer adjacent to said second skin, and a second outer layer adjacent to said second inner layer, said frame including a first cavity, said first inner layer of sound absorbing material positioned within said first cavity, said frame including a second cavity, said second inner layer of sound absorbing material positioned within said second cavity, said first outer layer of sound absorbing material overlying said first inner layer of sound absorbing material and a face of said frame, said second outer layer of sound absorbing material overlying said second inner layer of sound absorbing material and a face of said frame, said inner and outer layers of sound absorbing material being unbonded.

11. An apparatus as recited in claim 10, further comprising a first fabric layer adjacent to said first outer layer, and a second fabric layer adjacent to said second outer layer.

12. An apparatus as recited in claim 10, wherein said first and second inner layers of sound absorbing material comprise fibrous material having a density of approximately 48 kg/m$^3$.

13. An apparatus as recited in claim 12, wherein said first and second outer layers of sound absorbing material comprise fibrous material having a density of approximately 24 kg/m$^3$.

* * * * *

UNITED STATES PATENT AND TRADEMARK OFFICE

CERTIFICATE OF CORRECTION

PATENT NO. : 5,424,497
DATED : June 13, 1995
INVENTOR(S) : Gary R. Dias

It is certified that error appears in the above-indentified patent and that said Letters Patent is hereby corrected as shown below:

Col. 4, line 59, change "comer" to --corner--.

Col. 7, line 2, change "mourned" to --mounted--.

Signed and Sealed this

Twenty-fifth Day of February, 1997

*Attest:*

*Attesting Officer*

BRUCE LEHMAN

*Commissioner of Patents and Trademarks*